US008950820B2

(12) United States Patent
Patriciu

(10) Patent No.: US 8,950,820 B2
(45) Date of Patent: Feb. 10, 2015

(54) METHOD OF MINING AND PROCESSING SEABED SEDIMENT

(75) Inventor: Dan Costache Patriciu, Bucharest (RO)

(73) Assignee: Marine Resources Exploration International BV, Laren (NL)

( * ) Notice: Subject to any disclaimer, the term of this patent is extended or adjusted under 35 U.S.C. 154(b) by 875 days.

(21) Appl. No.: 13/002,198

(22) PCT Filed: Jul. 4, 2008

(86) PCT No.: PCT/EP2008/005490

§ 371 (c)(1),
(2), (4) Date: May 5, 2011

(87) PCT Pub. No.: WO2010/000289

PCT Pub. Date: Jan. 7, 2010

(65) Prior Publication Data

US 2011/0210599 A1 Sep. 1, 2011

(30) Foreign Application Priority Data

Jul. 2, 2008 (GB) ..... 0812119.6

(51) Int. Cl.
*E02F 7/00* (2006.01)
*E21C 50/00* (2006.01)
*E21B 43/01* (2006.01)

(52) U.S. Cl.
CPC ..... *E21C 50/00* (2013.01); *E21B 2043/0115* (2013.01)
USPC ..... 299/9

(58) Field of Classification Search
USPC ..... 299/7–9; 423/DIG. 4; 37/195, 307, 309, 37/313, 314, 317, 319–324, 329, 337, 342, 37/338, 339, 341, 343
See application file for complete search history.

(56) References Cited

U.S. PATENT DOCUMENTS

| | | | | |
|---|---|---|---|---|
| 4,424,866 | A | 1/1984 | McGuire | |
| 5,938,936 | A * | 8/1999 | Hodges et al. | 210/705 |
| 5,950,732 | A * | 9/1999 | Agee et al. | 166/354 |
| 6,209,965 | B1 | 4/2001 | Borns et al. | |

(Continued)

FOREIGN PATENT DOCUMENTS

| | | | |
|---|---|---|---|
| CN | 1458391 | A | 11/2003 |
| CN | 101182771 | A | 5/2008 |

(Continued)

OTHER PUBLICATIONS

International Preliminary Report on Patentability corresponding to International Application No. PCT/EP2008/005490; Date of Mailing: Jan. 13, 2011; 7 pages.

(Continued)

*Primary Examiner* — Sunil Singh
(74) *Attorney, Agent, or Firm* — Myers Bigel Sibley & Sajovec, PA

(57) ABSTRACT

A method and apparatus for mining and processing seabed sediment comprising disturbing sediment at the seabed (3) to form a slurry; transporting the slurry to the surface via a production riser (6) and processing the slurry to dissociate hydrates and remove hydrates from the slurry in gaseous form at the surface. The slurry may also contain sapropel and minerals. If so, the slurry may be split into a mineral rich stream and a sapropel rich stream each of which may be subjected to further treatment.

18 Claims, 2 Drawing Sheets

(56) References Cited

U.S. PATENT DOCUMENTS

| | | | | |
|---|---|---|---|---|
| 6,299,256 | B1 | 10/2001 | Wyatt | |
| 6,817,427 | B2 * | 11/2004 | Matsuo et al. | 175/67 |
| 2003/0136585 | A1 | 7/2003 | Matsuo et al. | |
| 2003/0214175 | A1 | 11/2003 | Baciu | |

FOREIGN PATENT DOCUMENTS

| | | | |
|---|---|---|---|
| DE | 19715284 | A1 | 10/1998 |
| DE | 199 06 147 | A1 | 8/2000 |
| JP | 2006-161531 | | 6/2006 |
| RU | 1776298 | A3 | 11/1992 |
| WO | WO 98/44078 | | 10/1998 |
| WO | WO 01/14649 | A1 | 3/2001 |

OTHER PUBLICATIONS

International Search Report and Written Opinion of the International Searching Authority corresponding to International Application No. PCT/EP2008/005490; Date of Mailing: Dec. 11, 2008; 7 pages.

Search Report corresponding to Application No. GB0812119.6; Dated Jul. 23, 2008; 1 page.

* cited by examiner

METHOD OF MINING AND PROCESSING SEABED SEDIMENT

CROSS-REFERENCE TO RELATED APPLICATIONS

The present application is a 35 U.S.C. §371 national phase application of International Application Serial No. PCT/EP2008/005490, filed Jul. 4, 2008, which claims priority to Great Britain Patent Application No. 0812119.6, filed Jul. 2, 2008, the entire contents of each of which are incorporated herein by reference.

BACKGROUND OF THE INVENTION

The present invention relates to a method of mining and processing seabed sediment.

At present, there is minimum activity in the field of seabed mining. It is an area that is beginning to be developed by companies such as Nautilus Minerals who use crawler techniques for mining mineral sulphides from the seabed. De Beers also use a number of mining methods. These include a horizontal system in which a seabed crawler brings diamond-bearing gravels to a surface vessel and a vertical system in which a drill recovers diamond-bearing gravels from the seabed.

Also of relevance to the present invention is the field of gas hydrate recovery. Various proposals exist to recover gas from gas hydrates that exist in geological formation below the earth's surface by a process that involves conventional drilling of a well similar to that used in the oil and gas industry to enter the hydrate bearing strata and then inducing the hydrate to dissociate by either reducing the pressure or increasing the temperature and or through chemical stimulation.

SUMMARY OF THE INVENTION

The present invention is directed to providing a new method of mining the seabed to recover materials that have not previously been recovered.

According to the present invention, there is provided a method of mining the seabed comprising the steps of:

1) disturbing sediment at the seabed to form a slurry;
2) transporting the slurry to the surface; and
3) processing the slurry to dissociate hydrates and remove hydrates from the slurry in gaseous form at the surface.

The present invention provides a method of mining the seabed to extract a gaseous stream from the gas hydrates. The slurry from which the gas has been separated may either be discharged, or may be further processed as set out below to yield further end products.

The sediment may be disturbed by a hydraulic uplift system. However, preferably, this is done by a remotely operated crawler mining tool as this is able to mechanically disturb the sediment.

Under some circumstances, depending upon the geology of the sediment, or the manner in which this has been mined from the seabed, the slurry transported to the surface may contain no oversized particles. However, preferably the method further comprises the step of passing the slurry through a screen to remove larger particles either before or during step 3.

The gas recovered from the hydrates may simply be transported for use without further processing. However, preferably, it is either liquefied or compressed to facilitate further handling. The compressed gas may be conveyed to the seabed to assist in transporting the slurry to the surface.

If the slurry contains an excessive amount of seawater, it may undergo a de-watering step.

Steps 1 to 3 of the method may be carried out at an offshore location. Once the gas has been extracted and, optionally, excess water has been removed in the de-watering step, the slurry is preferably transported to an on-shore location for further treatment. During such transportation, the slurry is preferably agitated to prevent the different materials from settling out which would otherwise hinder further handling of the slurry.

The slurry from which the gas has been extracted in step 3) may then be further processed. In one application, this slurry will contain minerals and sapropel. Sapropel is a known term of art for sediments that are rich in organic matter. The method further comprises the step of separating the slurry into a mineral rich stream and a sapropel rich stream. Further de-watering may be carried out during this separation. Alternatively, the two streams may be dewatered individually at a later stage. The mineral rich stream can further be separated into a number of streams each rich a particular mineral. The sapropel rich stream is preferably processed to produce usable fuel and/or energy.

The streams may be separated by a centrifuge to produce sapropel and mineral sediments. The centrifuge may also provide de-watering.

Gasification may be applied to the sapropel rich stream to produce synthetic gas.

Further separation is applied to the mineral rich stream to produce separate mineral sulphides, mineral oxides or metals.

According to a second aspect of the present invention there is provided an apparatus for mining and processing seabed sediment comprising a crawler mining tool for travelling across the seabed and forming a slurry; a production riser to transport the slurry from the crawler to the surface; a first separator to dissociate hydrates and remove hydrates from the slurry in gaseous form at the surface. A second separator is preferably provided for separating the slurry into a mineral rich stream and a sapropel rich stream. A third separator is preferably for separating the mineral rich stream into a number of streams each rich in a particular mineral. A sapropel processing plant is preferably provided to process the sapropel rich stream to produce useable fuel.

BRIEF DESCRIPTION OF THE DRAWINGS

An example of a method and apparatus in accordance with the present invention will now be described with reference to the accompanying drawings, in which.

DETAILED DESCRIPTION OF EMBODIMENTS OF THE INVENTION

Figure 1:
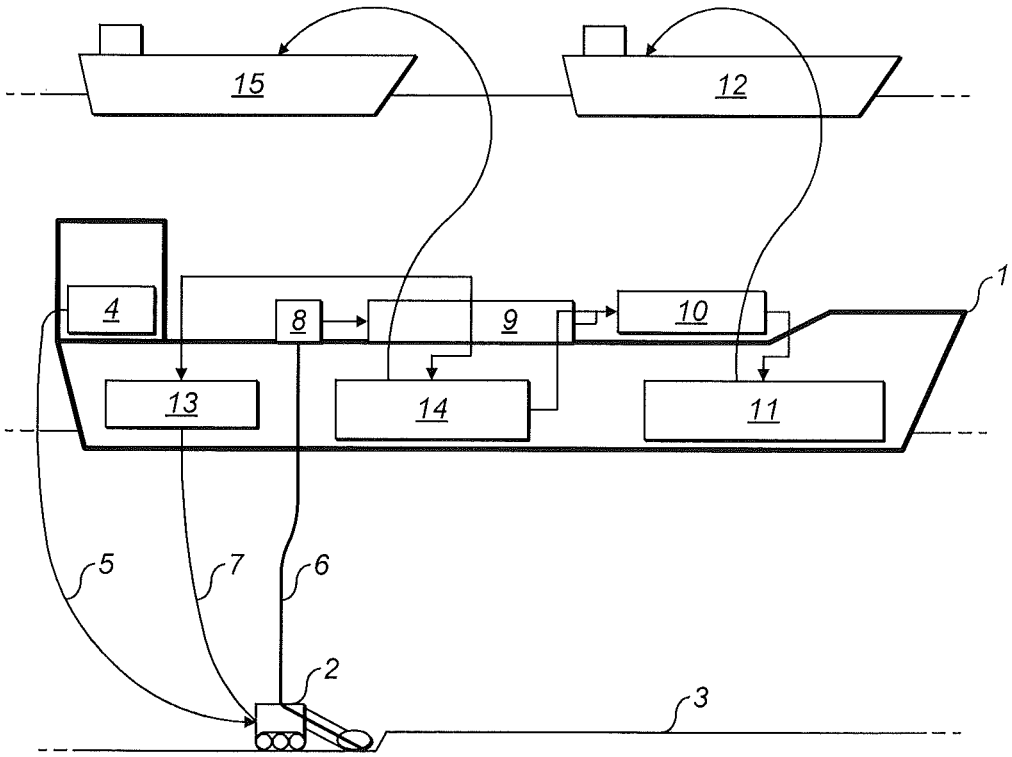
FIG. 1 is a schematic representation of the offshore components of the system.

The offshore components of the system are centred around a floating production vessel 1 which houses various items of production equipment described in detail below.

The mining of the seabed is carried out by a crawler mining tool 2 which is designed to operate at sea depths of up to 2000 m and is controlled from a control module on board the production vessel. The crawler mining tool is a directionally manoeuvrable tractor vehicle which can travel along the seabed 3 and is equipped with a mechanism for mechanically recovering sediments in the form of a mechanical cutting head to disturb the sediments and reduce particle size, combined with suction to recover the disturbed sediment. The tool is driven by a hydraulic motor which is powered by a hydraulic power pack 4 on the vessel 1. This is connected to the vessel by an umbilical 5 which supplies hydraulic and electrical power to propel and control the vehicle. Both the rate of travel across the seabed and the excavation depth can be varied to achieve the desired recovery rate of sediment. The vehicle is also equipped with lights and CCTV cameras to aid control and direction and sonar devices to measure the thickness of the sediment layer.

The crawler 2 is connected to the vessel 1 by either a rigid riser constructed in sections from steel pipe or a flexible production riser 6 similar to those used in the offshore oil and gas industry constructed of a composite material including but not limited to spiral wound steel wires to provide mechanical strength, rubber and thermoplastic layers to provide flexibility and insulation. The riser has an internal diameter of between 200 mm and 600 mm. The diameter is designed to achieve an optimum flow rate of up to 20 m/s. The excavated sediments mix with sea water to form a slurry. This is propelled to the production vessel 1 using a combination of a vacuum pump located on the crawler mining tool 2 to provide initial suction and feed into the riser and a gas lift process whereby compressed gas is injected along umbilical 7 into the lower section of the riser. This induces the slurry and gas mixture to flow through the production riser 6 to the vessel 1. The flow rate of the slurry is controlled by varying the pump or the gas injection flow rate.

As the slurry travels along production riser 6, the pressure drops and the gas hydrates naturally begin to dissociate. This process may be assisted by the microwave generating rings.

At the production vessel, the slurry is first passed through a classifying screen 8 where large particles are removed by self or manual cleaning of the screen. The screen, which can also be a rinsing screen, is a stationary or impact screen or can be a plane sifter or inclination screen.

The slurry which passes through the screen contains free gases and small pieces of hydrate that have not fully dissociated. This is fed to the separator train 9 which incorporates a cyclone to separate the solids from the slurry leaving the water and gas which is fed to a two phase separator. The pressure and temperature through the separator train 9 are controlled dependent on the flow rate and composition of the slurry. The gases from the separator 9 which may include methane, ethane, propane, hydrogen sulphide and carbon dioxide are fed to the further processing stage 10 which will include gas conditioning and a liquefaction plant such as a gas turbo-expander based process, which includes an expander refrigeration cycle such as the reverse-Brayton cycle. The compressed or liquefied gas is fed to a holding tank 11. The compressed or liquefied gas is then fed to a compressed/liquefied gas carrier vessel 12 to be transported ashore.

Some of the gas from the separator is fed to a gas compression system 13 which supplies gas to the crawler 2 along umbilical 7.

The gas free slurry from the separator train 9 is transported to a slurry holding tank 14 where additional seawater can be added if necessary to maintain the slurry in a condition suitable to pump it to bulk carriers 15 equipped with cargo tanks to contain the slurry. The cargo tanks contain agitators and/or a recycle pumping system to discourage separation of the sediments and seawater within the tanks and maintain the sediments in a suspended state. The bulk carriers 13 also incorporate an inert gas and venting system to provide a blanket of inert gas in the tanks to eliminate the presence of oxygen to mitigate the risk of an explosive air gas mixture being created as a result of any residual gas within the slurry and thereby transporting the slurry in a safe condition.

Figure 2:
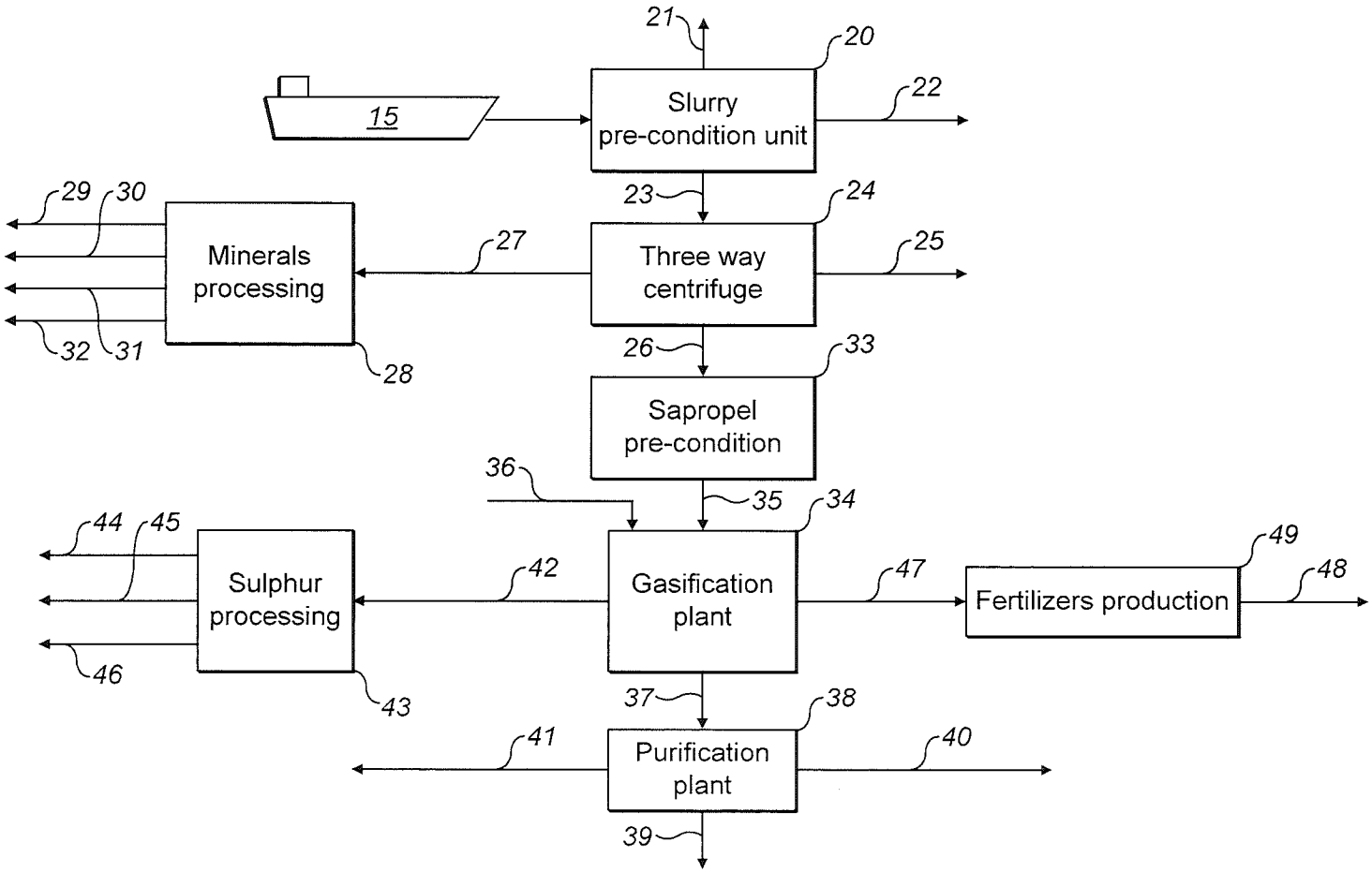
FIG. 2 is a schematic representation of the on-shore components of the system.

FIG. 2 shows the processing of the degassed slurry from the bulk carriers 15. Although this process is described as being carried out on-shore, it will be appreciated that this process can also be carried out offshore. Indeed, the point at which the slurry is transported ashore can be at any point in the processing following the mining of the slurry by the crawler mining tool 2.

The degasified slurry sediment from the bulk carrier 15 is a mixture of sediments which were formed or concentrated during sedimentation and diagenesis. It is rich in minerals existing especially as metal sulphides in crystalline form, organometallic compounds, gas hydrates and organic matter which consists of a complex mixture of high molecular weight hydrocarbons, saturated sterols, fatty acids and humic acids. The slurry from the carrier 15 is first fed to a slurry preconditioning unit 20 which is a residence vessel in which residual gases 21 including methane, ethane, propane, hydrogen sulphide and carbon dioxide are recovered and sent to be combined with the syngas obtained from the gasification plant described below. A layer of water readily forms on top of the slurry and this can be decanted as decanted water stream 22.

The preconditioned slurry stream 23 is fed to a three-way centrifuge 24 which can be a Bikel Wolf of Alpha Laval centrifuge which is used in any application which involves water in organic sediment or a mixture of different densities of inorganic phase, organic phase and water. The centrifuge separates the liquid phase of the seawater as waste water stream 25 which is returned to the sea. The light solids which are rich in sapropel are separated as sapropel stream 26, while the heavy sediment separated at the bottom of the centrifuge contains the metallic sulphides and organometallic compounds as mineral stream 27.

The mineral stream 27 is processed using well known techniques for mineral processing at mineral processing stage 28. Extractive metallurgy techniques are used to reduce the oxide and sulphide minerals to liberate the desired minerals by reduction methods including chemical or electrolytic techniques. These are followed, in many cases, by electrolyse, selective melting, fractionation and electrical treatment to produce separated metal elements or compatible alloys. Depending upon the specific composition of the metallic sulphides, the chemical reduction can be carried out in a variety of processes including hydrogen and reductive melting with a selective reducing agent, preferably coke or charcoal, and purifying agent to separate the pure molten metals (such as iron 29, magnesium 30 and aluminium 31 from the waste products 32).

The sapropel stream 26 then enters a preconditioned stage 33 in which excess water is removed by either decanting in a residence tank or by centrifuging to produce a dewatered, partially dewatered or dry organic matter. This can be used as a blending component for manufacturing coal or petcoke briquettes or a direct firing fuel mixture. However, preferably, the conditioned sapropel stream 35 is fed to a gasification plant 34 in which it is gasified by partial oxidation of the organic matter with oxygen 36 producing raw synthetic gas (Syngas) using the Fisher-Tropsh method of coal gasification, such as the Shell Gasification Process (SGP) which adds value to the gasification process by the integration of the gasification plants into a combined cycle power plant to produce electricity.

The resultant Syngas stream 37 is then passed through a purification plant 38 which can provide separation of the remaining carbon dioxide, sulphur dioxide and water in excess which can be separate or combined with the gasification plant 34 to obtain clean Syngas with a technical specification necessary to obtain electricity and steam 39, clean Syngas for refinery use 40 or hydrocarbons by organic synthesis 41.

The gasification plant 34 also produces an effluent which contains sulphur dioxide 42 from which the sulphur is recovered in a sulphur processing plant 43 by known technologies like the Claus process for pure sulphur. The sulphur dioxide can be converted into sulphuric acid 44, using the Stratco-DuPont technology or granulated sulphur 45 for bitumen modification or concrete with sulphur content or sulphur for industrial use 46. Depending on the mineral content, ash 47 may also be produced in the gasification plant 34. This is rich in microelements which are suitable blending components to produce fertilisers 48 at step 49.

The invention claimed is:

1. A method of mining and processing seabed sediment comprising the steps of:

disturbing sediment at the seabed using a remotely operated crawler mining tool to form a slurry;

transporting the slurry to the surface via a production riser;

processing the slurry to dissociate hydrates and remove hydrates from the slurry in gaseous form at the surface; and transporting the slurry or components of the degasified slurry to an on-shore location.

2. A method according to claim 1, wherein transporting the slurry comprises conveying compressed gas to the seabed to assist in transporting the slurry to the surface.

3. A method according to claim 1, further comprising the step of passing the slurry through a screen to remove larger particles either before or during the step of processing the slurry.

4. A method according to claim 1, wherein gases derived from the hydrates are subsequently liquefied.

5. A method according to claim 1, wherein the gases derived from the hydrates are subsequently compressed.

6. A method according to claim 5, wherein some of the compressed gases derived from the hydrates are conveyed to the seabed to assist in transporting the slurry to the surface.

7. A method according to claim 1, further comprising agitating the slurry during the transportation to the on-shore location.

8. A method according to claim 7, further comprising partially de-watering the slurry.

9. A method according to claim 1, further comprising separating the slurry into a mineral rich stream and a sapropel rich stream.

10. A method according to claim 9, wherein de-watering and separating the slurry into a mineral rich stream and a sapropel rich stream are carried out simultaneously in a three-way centrifuge.

11. A method according to claim 9, further comprising separating the mineral rich stream into a number of streams each rich in a particular mineral.

12. A method according to claim 11, wherein separating the mineral rich stream comprises separating the mineral rich stream into separate mineral sulphides, mineral oxides or metals.

13. A method according to claim 9, further comprising processing the sapropel rich stream to produce usable fuel and/or energy.

14. A method according to claim 13, wherein the step of processing the sapropel rich stream comprises the step of gasifying the sapropel rich stream to produce the usable fuel and/or energy.

15. An apparatus for mining and processing seabed sediment comprising a crawler mining tool configured to travel across the seabed and form a slurry; a production riser configured to transport the slurry from the crawler to the surface; a first separator configured to dissociate hydrates and remove hydrates from the slurry in gaseous form at the surface; and means to transport the slurry or components of the degasified slurry to an on-shore location.

16. An apparatus according to claim 15, further comprising a second separator configured to separate the slurry into a mineral rich stream and a sapropel rich stream.

17. An apparatus according to claim 16, further comprising a third separator configured to separate the mineral rich stream into a number of streams each rich in a particular mineral.

18. An apparatus according to claim 17, further comprising a sapropel processing plant configured to process the sapropel rich stream to produce useable fuel and/or energy.

* * * * *